United States Patent [19]

Simmons

[11] 4,306,332

[45] Dec. 22, 1981

[54] TRAVERSE CURTAIN SUPPORTING APPARATUS

[76] Inventor: Logan E. Simmons, 4166 Center St., Baldwin Park, Calif. 91706

[21] Appl. No.: 125,669

[22] Filed: Feb. 28, 1980

[51] Int. Cl.[3] ..... E05D 13/02; A47H 15/00

[52] U.S. Cl. ..... 16/96 D; 16/87.6 R; 160/346

[58] Field of Search ..... 16/87.2, 96 D, 87.6 R, 16/96 R, 87.8, 95 R, 95 D, 94 D, 94 R, 93 R, 93 D; 160/344, 345, 346, 347

[56] References Cited

U.S. PATENT DOCUMENTS 3,016,951 1/1962 Greene ..... 160/346
3,361,191 1/1968 Goble ..... 16/87.6 R

FOREIGN PATENT DOCUMENTS 1214606 11/1959 France ..... 160/346
Ad.88163 11/1966 France ..... 16/93 D
726566 12/1966 Italy ..... 16/94 D
413105 7/1934 United Kingdom ..... 16/87.8

*Primary Examiner*—James Kee Chi
*Attorney, Agent, or Firm*—Christie, Parker & Hale

[57] ABSTRACT

An apparatus for suspending a traverse curtain on a common track assembly. The track assembly has opposed generally horizontally extending flanges. Mounted on the track is a carriage having spaced apart rollers, each of the rollers rotating about a respective and substantially vertical axis of rotation. A separate one of the rollers engages each flange for moving the carriage along the track. The rollers rotate in a plane parallel to the plane defined by the flanges. The rollers are located for preventing jamming of the carriage at curved portions of the track. Curtain supports are attached to the carriage for supporting a respective portion of the curtain.

13 Claims, 6 Drawing Figures

TRAVERSE CURTAIN SUPPORTING APPARATUS

BACKGROUND OF THE INVENTION

Traverse curtains are frequently suspended from track assemblies by a number of commercially available track and carrier systems. Such systems used, for example, for suspending a traverse curtain in a theatrical application include two individual tracks that overlap at the center of a stage. The overlapping tracks provide means for overlapping the vertical borders of the curtain when the curtain is drawn together.

Known traverse curtain carriers typically include a carriage that is supported by wheels, that travel on an I-beam shaped track in response to the motion of a pull cord attached to the carriage. The track has horizontal upper and lower flanges connected by a vertical web. Typically, the wheels rotate about a horizontal axis on the lower flanges of the track. The carriages are characterized in that they jam against the web. Normally the jamming occurs as the carriage travels along a curved portion of the track. Attempts have been made to reduce the amount of jamming of the carriage against the web by the placement of low-friction material such as Teflon on the surfaces of the carriage that normally come in contact with the web.

The shape and orientation of the rollers on the carriage of this invention enables the simiplification of the number of parts needed for coupling a traverse curtain carriage to a common track while eliminating contact of the carriage with the web of the track. Significantly this reduces the amount of friction between the carriage and the track as the carriage travels along curved portions of the track.

SUMMARY OF THE INVENTION

Briefly stated, the apparatus of this invention includes a common track assembly that has opposed generally horizontally extending flanges. A carriage is secured to the flanges by means of a plurality of spaced apart rollers mounted on the carriage about respective vertical axes of rotation. Means are provided for suspending a curtain from the carriage.

As a feature of the invention, a separate roller is adapted to engage each flange of the track for moving the carriage along the track. The rollers have a concave peripheral groove which receives a corresponding flange of the track.

Preferably, the carriage has three spaced apart rollers, two rollers engaging one flange, the third roller engaging the other flange. The two rollers are located on the outside of a curved portion of the track, and the third roller, is located on the inside of a curved portion of the track and has an axis lying mid-way between the axes of the two rollers. Significantly, the carriage tends to roll around the curved portion of the track, about the third roller, eliminating thereby sliding friction between the carriage and track. Thus, the carriage is prevented from binding with the web of a curved portion of the track.

Preferably the apparatus also includes a plurality of carriers mounted on the track. The carriers have two spaced apart rollers mounted for rotation about respective vertical axes of rotation. A separate roller is adapted to engage each flange of the track for moving the carrier along the track. The carrier tends to roll around the curved portion of track eliminating thereby sliding friction between the carriage and track. The carriers include means for suspending a traverse curtain at respective spaced apart stations along the horizontal upper edge of the curtain.

DETAILED DESCRIPTION

Figure 1:
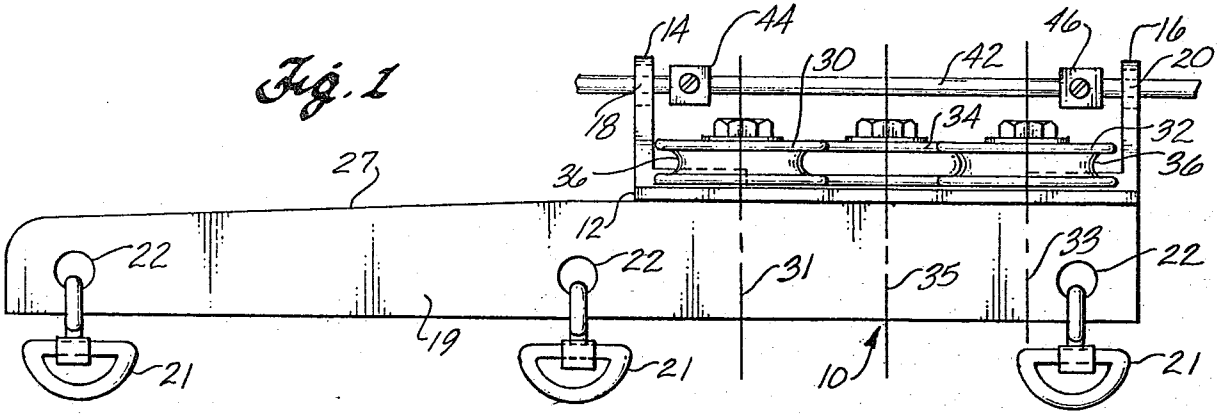
FIG. 1 is a front elevation view of a carriage according to the invention.

FIG. 1 shows a leader carriage 10 of a form adapted to incorporate the teachings of this invention. The carriage 10 includes a base 12 and an overlap arm 19. Base 12 has a pair of peripherally mounted upstanding tabs 14 and 16. The tabs 14 and 16 have holes 18 and 20, respectively, having a diameter sufficient to receive conventional curtain pull cords. Overlap arm 19 is mounted at the undersurface of the base 12 and extends forwardly from the base 12. The overlap arm 19 is parallel to and slightly offset from a center line 23 of the carriage. The overlap arm 19 has a downward sloping upper edge portion 27 and a rearward extremity that is flush with the rearward extremity of the base 12.

A vertical border portion of a traverse curtain is suspended from the carriage by means of spaced apart swivel eyelets 21 that are hooked through spaced apart openings 22 located in the overlap arm 19. The upstanding tabs 14 and 16 as well as the overlap arm 19 are all rigidly secured to the base 12 by welding or any conventional attachment means.

Rollers 30, 32 and 34, preferably identically shaped, are mounted for rotation on the upper surface of base 12 about respective and substantially vertical axes of rotation 31, 33 and 35. Each roller is in the general shape of a pulley having a peripheral annular concave groove 36.

Figure 2:
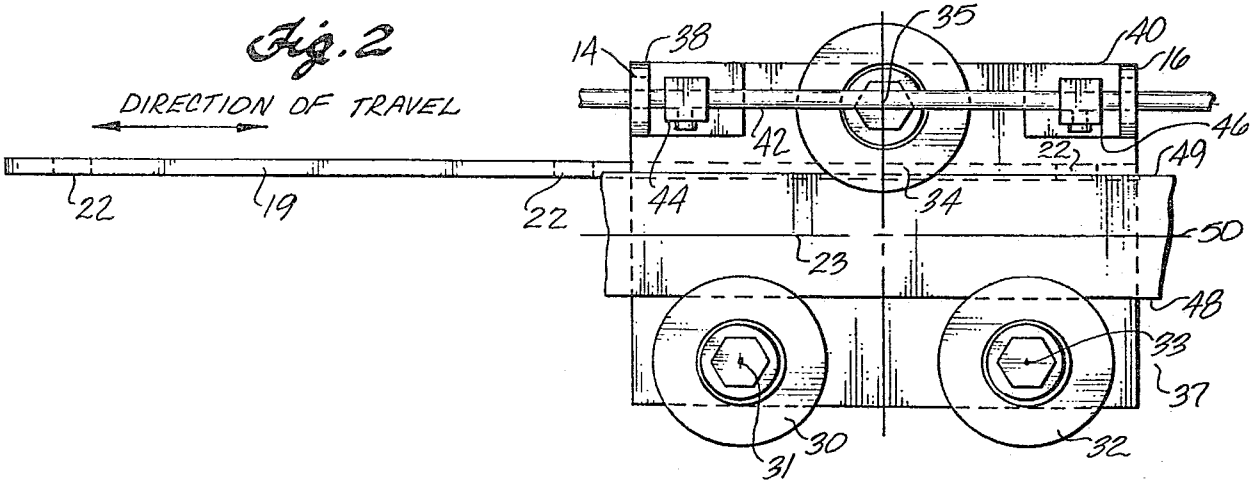
FIG. 2 is a top plan view of the carriage of FIG. 1.
Figure 3:
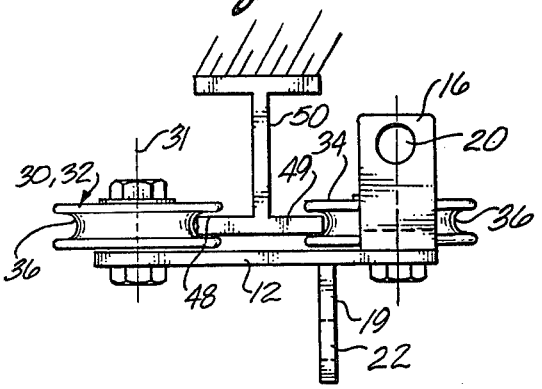
FIG. 3 is a side elevation view of the carriage of FIG. 1.

The position of upstanding tabs 14 and 16, overlap arm 19 and rollers 30, 32 and 34 relative to the base 12, are more clearly shown in FIGS. 2 and 3. The direction of travel of the carriage 10 on a suspended I-beam track assembly 50 (hereinafter referred to as track 50) is controlled by the engagement of the rollers 30, 32 and 34 with the lower horizontal flanges 48 and 49 of the tract 50. The upper horizontal flanges (not shown in FIG. 2) of track 50 are attached to a track support surface, such as a ceiling, (see FIG. 3), by any one of a number of conventional attachment techniques. Rollers 30, 32 and 34 are outboard of track 50 on base 12 rather than inboard of the track and adjacent the web as characterized by the prior art. More specifically, rollers 30 and 32 are spaced apart and have respective axes of rotation 31 and 33 that lie in a plane 37 that is parallel to the normal direction of travel of the carriage on the track. Each annular groove 36 of rollers 30 and 32 engages the flange 48 of the track 50.

Roller 34 is located opposite rollers 30 and 32, and engages flange 49 of the track 50. The axis 35 of the roller 34 is spaced from the plane 37 an amount sufficient to permit flanges 48 and 49 to be held between rollers 30, 32 and 34 respectively and yet permit rotation of the rollers on the flanges as the carriage travels along the track. Preferably, the axis 35 of roller 34 lies in a plane 39 that intersects the plane 37 mid-way between the axes of rotation 31 and 33. The concave groove of each of the rollers provides means for embracing the flanges and thus the rollers hold the carriage on the track. The concave grooves prevent vertical motion of the carriage relative to the track and restrict travel of the carriage along the track in a horizontal plane defined by the flanges 48 and 49. Significantly, and by virtue of the concave shape of the grooves, the rollers contact the flanges principally at a point in the roller groove. The frictional forces between the flange and rollers as they come in contact is thereby reduced as contrasted with roller grooves having, for example, a rectangular configuration.

The rollers 30, 32 and 34 may be any one of a number of conventional commercially-available low friction ball bearing rollers.

Upstanding tabs 14 and 16 are located in corners 38 and 40 respectively of the base 12. Holes 18 and 20 in upstanding tabs 14 and 16 respectively receive a curtain pull cord 42. Secured to the pull cord 42 between tabs 14 and 16 are conventional cord locks 44 and 46. The cord locks 44 and 46 are spaced apart a distance slightly less than the distance between the tabs 14 and 16. Cord locks having a bore capable of receiving a pull cord and a threaded screw capable, when tightened, of locking the pull cord to the cord lock are satisfactory. Motion of the pull cord in a forward direction causes the cord lock 44 to abut against tab 14 thereby urging the carriage in a forward direction. Motion of the pull cord in an opposite direction, i.e., reverse direction, causes cord lock 46 to abut against tab 16, thereby urging the carriage in a reverse direction.

Figure 4:
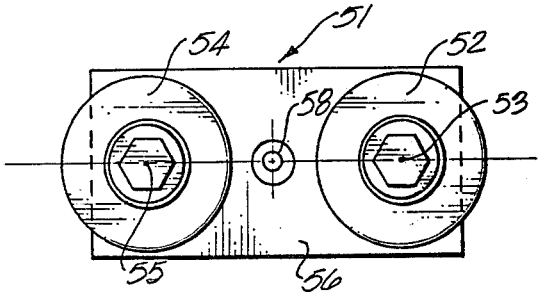
FIG. 4 is a top plan view of a carrier according to the invention.
Figure 5:
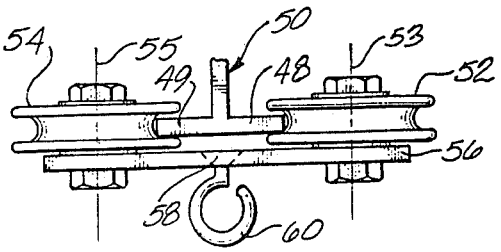
FIG. 5 is a front elevation view of the carrier of FIG. 4.

Referring to FIG. 4, there is shown a carrier 51 having spaced apart rollers 52 and 54. Typically a plurality of carriers 51 are mounted to the track 50 and suspend therefrom, at spaced apart stations, the traverse curtain that lies between the vertical borders of such curtain.

The carrier 51 has an essentially flat rectangular base 56 having a countersunk bore 58 centrally located in the base. The bore 58 is adapted to receive a bevel tipped ring-shaped swivel eyelet 60 downwardly suspending from the base 56. Conventional attachment means such as spring snaps or "S" hooks (both not shown) are satisfactory for securing the curtain at separate stations from respective eyelets.

The rollers 52 and 54 are mounted outboard of track 50 on the base 56 for rotation about respective and substantially vertical axes of rotation 53 and 55, respectively. The rollers 52 and 54 are preferably the low friction roller bearing pulley-shaped device described for use in the carriage 10. Preferably the rollers 52 and 54 are identically shaped, the respective axes of rotation being spaced apart a distance sufficient to permit the rollers to hold the carrier on the track, and thus travel of the carrier 51 on the track is restricted to a plane (typically horizontal) defined by the flanges.

Figure 6:
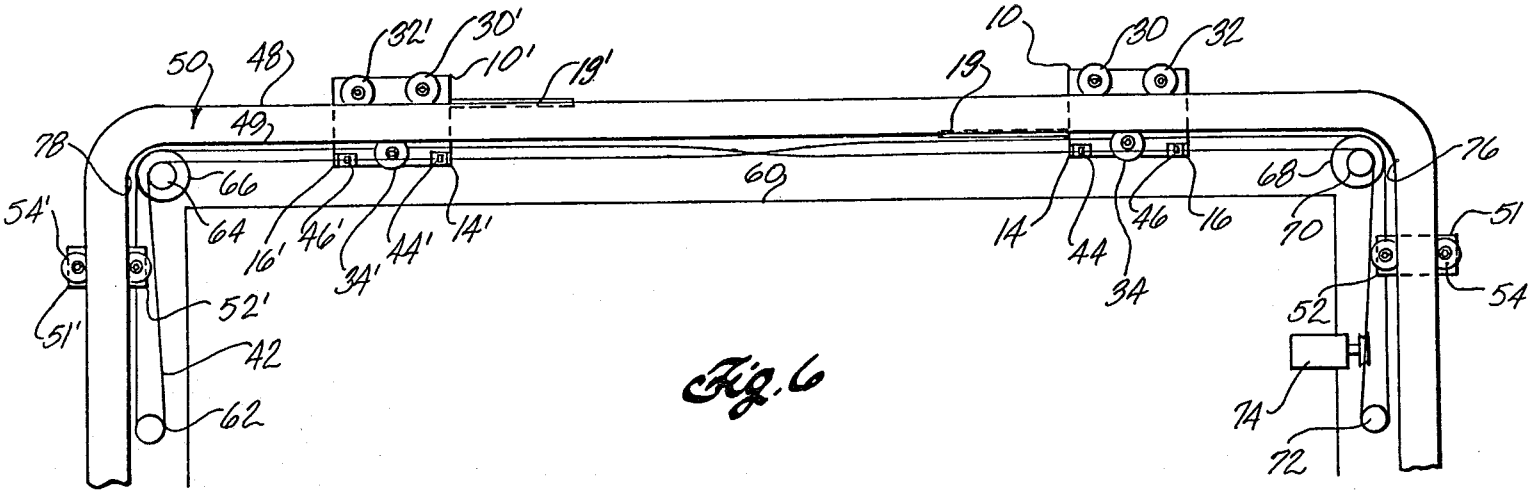
FIG. 6 i s a schematic top view of a curtain support system incorporating the carriage and carriers of this invention in a theater application.

Referring now to FIG. 6, there is shown a curtain support system in which the carriages and carriers of FIGS. 1 through 5 are arranged for suspending traverse curtains in a theatrical application. More specifically, track 50 is suspended from a ceiling or wall by any of a number of conventional techniques and circumscribes a theatrical stage 60. A pair of carriages 10 and 10', are mounted on the track 50 so that the overlap arms 19 and 19' are in facing relation. The overlap arms 19 and 19' are offset from each other so that in a drawn-together condition a vertical border of curtains (not shown) attached to the respective arms will overlap each other. Pull cord 42 is wrapped around pulleys 62, 64, 66, 68, 70 and 72 to form a continuous closed loop. The pulleys are mounted on the track or wall above the carriages and carriers. The pull cord 42 passes through upstanding tabs 14, 16 and 14' and 16' of the respective carriages 10 and 10'. Cord locks 44, 46 and 44' and 46' secured to the pull cord 42 interlock the cord with the respective carriage such that motion of the cord causes a corresponding motion in the carriages. The placement of the pull cord 42 in the carriages and the placement of the pull cord 42 on the pulleys, as shown in FIG. 6, provide symmetrical control over the movement of the carriages by the use of a single pull cord. Thus, movement of the cord in one direction causes the carriages to be drawn together, whereas movement of the cord in the opposite direction causes the carriages to be drawn apart. The movement of the pull cord may be provided manually or by use of any of a number of conventional techniques such as a controllable motor drive unit 74 coupled to the pull cord.

A plurality of carriers 51 and 51' are mounted on track 50 between the vertical borders of the curtains to support such curtains. Although only two carriers are shown in FIG. 6, more would generally be provided depending on the track length. The carriers are not secured to the pull cord, and are urged along the track by the curtain suspended therefrom as the curtain is drawn along the track.

The location of rollers 34 and 34' on their respective carriages provides jam-free travel around the curved portions 76 and 78 of the track 50. More specifically, the roller 34 of carriage 10 provides a pivotal axis about which the carriage 10 pivots as the carriage travels around the curved portion 76. The pivoting of the carriage about the roller 34 as the carriage is guided by the rollers rolling on the flanges through the turn thus prevents jamming of the carriage as it travels through such turns. Similarly, the interior rollers 52 and 52' act as pivots about which carriers 51 and 51' pivot as the carriers travel through the curved portions 76 and 78.

It should be noted that although three rollers have been described for use in the carriage 10, a two-roller arrangement such as described for the carrier 51 may be used for the carriage. It has been found, however, in practice, that the three-roller arrangement described for the carriage 10 provides a greater amount of friction free or non-binding travel along the track than use of the two-roller carrier. More specifically, the downward pull of the curtain on the overlap arm 18 causes a corresponding moment about the forward most rollers 30 and 34 of the carriage. The moment, if not opposed, would cause the carriage to rotate on the flanges, thereby causing the rollers to bind on the track. The rearward most roller 32, however, due to its welding engagement with the flange 48, prevents rotation of the carriage such that the base 12 of the carriage is maintained in a plane parallel to the plane defined by the flanges 48 and 49, and binding of the rollers to the track is prevented.

While the basic principles of this invention have been herein illustrated along with two embodiments, it will be appreciated by those skilled in the art that variations in the disclosed arrangement, both as to its details and as to the organization of such details, may be made without departing from the spirit and scope thereof. Accordingly, it is intended that the foregoing disclosure and the showings made in the drawings will be considered only as illustrative of the principles of the invention and not construed in a limiting sense.

What is claimed is:

1. Apparatus for suspending a traverse curtain on a track assembly, the assembly having opposed generally horizontally projecting flanges, the apparatus comprising:

a carriage having first, second and third spaced apart rollers, each of the rollers being outboard of the flanges and mounted for rotation about respective and substantially vertical axes of rotation, the first and second rollers adapted to engage one flange, the third roller adapted to engage the other flange, so as to support the carriage and guide the movement of the carriage along the track assembly; and curtain supports attached to the carriage for supporting a respective portion of the curtain.

2. The apparatus of claim 1 wherein the first and second roller axes lie in a first plane and the third roller axis lies in a second plane that is substantially orthogonal to the first plane, the second plane intersecting the first plane at a point located between said first and second roller axes.

3. The curtain support system of claim 2 wherein the second plane intersects the first plane at a point midway between the first and second roller axes.

4. The curtain support system of claim 2 wherein the vertical axis of the third roller provides a pivotal axis about which the carriage pivots as the carriage travels along a curved portion of the track.

5. The curtain support system of claim 2 wherein the first and second and third rollers are spaced apart so that the flanges are held between respective rollers.

6. The curtain support system of claim 5 wherein the rollers have a peripheral annular concave groove for engaging the flanges so that the flanges contact the rollers principally at a point on the concave surface of the groove as the rollers travel along the flanges.

7. The curtain support system of claim 6 wherein the flanges have a rectangular cross section for contacting the roller groove at a point on the concave surface thereof.

8. The apparatus of claim 2 wherein the carriage includes an extension arm extending from said first carriage, the extension arm having supports for supporting a vertical border portion of the curtain.

9. A curtain support system comprising:

a common track assembly, the assembly having two opposed, generally horizontally extending flanges;

first curtain transport means comprising a carriage having first, second and third spaced apart rollers, each of the rollers rotating about a respective and vertical axis of rotation, the first and second rollers adapted to engage one flange, the third roller adapted to engage the other flange, said first, second and third rollers for supporting the carriage and for guiding the movement of the carriage along the track assembly;

second curtain transport means having fourth and fifth spaced apart rollers, each of the rollers rotating about a respective and substantially vertical axis of rotation, the fourth roller adapted to engage one flange and the fifth roller adapted to engage the other flange for supporting and guiding the second curtain transport means along the track; and curtain supports attached to the first and second curtain transport means for supporting a respective portion of the curtain.

10. The curtain support system of claim 9 wherein the second curtain support means is a carriage.

11. The curtain support system of claim 10 including a plurality of carriers, each carrier having sixth and seventh spaced apart rollers, each of the sixth and seventh rollers rotating about a respective and substantially vertical axis of rotation, the sixth roller adapted to engage one flange and the seventh roller adapted to engage the other flange for supporting and guiding the carriers along the track.

12. The curtain support system of claim 10 wherein the carriages each include an extension arm extending forwardly therefrom so that when the first and second curtain support means are mounted on the track in facing relation and when the first and second support means are in a drawn together condition the respective extension arms overlap in side-by-side fashion.

13. The curtain support system of claim 12 wherein the extension arms have supports for suspending a vertical border of the curtain.

* * * * *